United States Patent [19]

Moore

[11] 4,409,021

[45] Oct. 11, 1983

[54] SLAG DECARBONIZATION WITH A PHASE INVERSION

[75] Inventor: Thomas W. Moore, Florence, Ala.

[73] Assignee: Reynolds Metals Company, Richmond, Va.

[21] Appl. No.: 375,492

[22] Filed: May 6, 1982

[51] Int. Cl.[3] ..... C22B 4/02; C22B 21/02

[52] U.S. Cl. ..... 75/10 R; 75/63; 75/68 A; 75/93 AC

[58] Field of Search ..... 75/10 R, 68 R, 68 A, 75/63, 93 AC

[56] References Cited

U.S. PATENT DOCUMENTS 4,216,010 8/1980 Kibby ..... 75/68 A 4,224,054 9/1980 Southam ..... 75/10 R

*Primary Examiner*—M. J. Andrews

*Attorney, Agent, or Firm*—Lyne, Girard & McDonald

[57] ABSTRACT

A batch method is described for decarbonizing aluminum primary furnace product from an aluminum carbide content of up to about 35% to a useful content of about 2% $Al_4C_3$. The method maximizes mass transfer of the aluminum carbide from molten primary furnace product to molten slag and molten alumina in a decarbonization furnace which has elevatable electrodes and is operated in the extraction mode according to the equation:

$$Al_4C_3 + 4Al_2O_3 \rightarrow Al_4O_4C.$$

The method comprises forming an overlying molten layer of primary furnace product, preferably as an aluminum alloy containing 9.5% $Al_4C_3$ and 12% $Al_2O_3$ and at a temperature of about 2100° C., and an underlying molten layer of slag, at a temperature of about 1900° C., and then adding an alumina cover layer of granular alumina onto the overlying layer of alloy melt. The method further comprises mechanically stoking the cover layer, while melting the alumina with the electrodes, to create globules of melted alumina within the overlying layer as a two-phase region having a plurality of interfaces across which the extraction principally occurs. As extraction proceeds, $Al_4O_4C$ and unreacted $Al_2O_3$ report to the underlying slag layer so that both the upper and lower interfaces at the top and bottom of the two-phase region, respectively, rise while the electrodes are elevated to maintain arcs between the electrodes and the upper interface, whereby electrical conditions remain constant within the furnace. When the alumina in the cover layer has completely melted and there is a layer of purified aluminum floating on a terminal slag pool, power input to the electrodes is decreased and the purifed aluminum is tapped from the furnace.

14 Claims, 7 Drawing Figures

SLAG DECARBONIZATION WITH A PHASE INVERSION

BACKGROUND OF THE INVENTION

1. Field of the Invention

This invention relates to the carbothermic production of aluminum from aluminum oxide and a carbon-containing material. It especially relates to purifying an aluminum reduction furnace product by removal of most of the relatively small amount of $Al_4C_3$ therein. It specifically relates to such purification by reacting occluded aluminum carbide with aluminum oxide at extraction mode temperatures.

2. Description of the Prior Art

Reviewing the literature and the patent are readily indicates that there has been much activity by many people in an attempt to define adequately a thermal process which can compete advantageously with the conventional electrolytic methods of preparing aluminum. The art has long been aware of the many theoretical advantages which can flow from the use of a thermal reduction method for the production of aluminum as opposed to an electrolytic method. These advantages are becoming increasingly important as energy costs continue to increase. Unfortunately, the vast majority of such carbothermic processes have not resulted in a significant production of aluminum in a substantially pure state.

Specifically, these efforts have failed because they have invariably produced a mixture of aluminum metal and aluminum carbide. When such a mixture of 10–20% carbide or more cools to about 1400° C., the aluminum carbide forms a cellular structure that entraps liquid aluminum; thus the mixture becomes difficult to pour. In consequence, unless extremely high temperatures are maintained throughout all of the steps, process manipulations of the mixture, in order to purify it, become extremely difficult, if not impossible.

The difficulty in producing aluminum with respect to thermal processes does not reside in the formation of the aluminum via reduction of the alumina-bearing ores, but rather, in the recovery of aluminum in a substantially pure state. The patent art, as well as the literature, is full of theories and explanations with respect to various back reactions which can take place between aluminum and the various carbon-containing compounds in the feed.

For example, U.S. Pat. No. 3,971,653 utilizes a slag containing an alumina mole fraction ($N^*$=moles $Al_2O_3$/(moles $Al_2O_3$+moles $Al_4C_3$) of 0.85 at a temperature of 2100° C., with recycle of $Al_4C_3$-containing dross to the portion of the slag which is at reduction temperature. However, because the entire reaction to produce metal occurs at $N^*=0.85$, the vaporization load is very high and the process power consumption is high.

U.S. Pat. Nos. 2,974,032 and 2,828,961 have described results that are typical of those to be expected from carbothermic reduction of a stoichiometric charge of alumina and carbon in a conventional electrically heated smelting furnace. The metal produced from the former process contains 20–37% $Al_4C_3$; the metal produced by the latter process contains 20% $Al_4C_3$. These processes are limited because reactive carbon and/or aluminum carbide is always present in contact with the metal that is produced and because time is available for the metal to react with the carbon and then to dissolve carbide up to its solubility limit.

One solution to the general problem of obtaining substantially pure aluminum from a carbothermic process is disclosed and claimed in U.S. Pat. No. 3,607,221. Although the process of this patent does result in the production of aluminum in a substantially pure state, extremely high operating temperatures are nevertheless involved which can lead to problems with respect to materials of construction. Another method for recovering substantially pure aluminum via a carbothermic process is disclosed and claimed in U.S. Pat. No. 3,929,456. The process of this patent also results in the production of substantially pure aluminum via a carbothermic process, but it does require careful control of the way the charge is heated in order to avoid aluminum carbide contamination.

By far, the most common technique disclosed in the prior art in attempting to produce aluminum of a high degree of purity has been directed to various methods of treating the furnace product which has conventionally contained about 20–35 weight percent of aluminum carbide. Thus, there are conventional techniques disclosed in the prior art, such as fluxing a furnace product with metal salts so as to diminish the amount of aluminum carbide contamination.

Unfortunately, the molten salts mix with the carbide so removed and it is costly to remove the carbide from the salts so that the carbide can be recycled to the furnace. Without such recycle, the power consumption and furnace size become uneconomical in comparison with prior methods practiced commercially for making aluminum.

U.S. Pat. No. 3,975,187 is directed towards a process for the treatment of carbothermically produced aluminum in order to reduce the aluminum carbide content thereof by treatment of the furnace product with a gas so as to prevent the formation of an aluminum-aluminum carbide matrix, whereby the aluminum carbide becomes readily separable from the aluminum. Although this process is very effective in preserving the energy already invested in making the aluminum carbide, it requires a recycle operation with attendant energy losses associated with material handling.

As disclosed in U.S. Pat. No. 4,099,959, a molten alumina slag is circulated through ducts, while being resistance heated in inverse relationship to the cross-sectional areas of the ducts, into alternating low and high temperature zones. The low-temperature zone is at a temperature high enough to produce aluminum carbide, and the high-temperature zone is at a temperature high enough to react aluminum carbide with alumina and produce aluminum. Off gases are first scrubbed through a first charge column containing only carbon and then through a second charge column containing only alumina in order to preheat these charge materials without forming a "sticky" charge because of partial melting of aluminum oxycarbide. The low and high temperature zones operate entirely within the molten range for a slag composition within $N^*$ values of 0.82–0.85.

U.S. Pat. Nos. 3,929,456 and 4,033,757 disclose methods for carbothermically producing aluminum containing less than 20% $Al_4C_3$, i.e., 5–10%, which comprise striking an open arc intermittently to a portion of the surface of the charge to be reduced.

However, advances have now been made in the art, wherein aluminum that is contaminated with about 20% aluminum carbide can be treated so as to obtain aluminum of commercial purity. One such technique is described in U.S. Pat. No. 4,216,010. This technique is adaptable to the production of aluminum containing less than 20% $Al_4C_3$ (i.e., 10%). It comprises the step of contacting a product containing from 20–35% $Al_4C_3$ with a melt rich in alumina in the absence of reactive carbon. Such purification techniques can impart commercial vitality to older carbothermic processes producing heavily contaminated aluminum. Thus it becomes worthwhile to locate the best existing prior art and to improve the effectiveness thereof.

The process of U.S. Pat. No. 4,216,010 is directed particularly towards treatment of aluminum which is contaminated with from about 20 to about 35 weight percent of aluminum carbide, which is that amount of carbide contamination which is produced by a so-called conventional carbothermic reduction furnace, but it may also be used to treat aluminum which is contaminated with from about 2 to about 10 weight percent aluminum carbide as would be produced in furnaces used primarily for the production of aluminum such as those described in U.S. Pat. Nos. 3,607,221 and 3,929,456.

The novel process of U.S. Pat. No. 4,216,010, all of which is hereby incorporated herein by reference, is carried out simply by heating the furnace product contaminated with aluminum carbide with a molten slag containing substantial proportions of alumina so as to cause the alumina in the slag to react with the aluminum carbide in the furnace product, thereby diminishing the content of aluminum carbide in the furnace product. The expression "alumina in the slag to react with the aluminum carbide" is intended to describe various modes of reaction. While not wishing to be limited to a particular theory of operation, nevertheless, it appears that at least 2 modes of reaction as between the alumina in the slag and the aluminum carbide in the furnace product are possible.

One such mode can be described as the "reduction mode" and it involves reaction between the alumina in the slag and the aluminum carbide in the furnace product at reduction conditions so as to produce aluminum metal. One way of ascertaining operation in this mode is by measuring the evolution of carbon monoxide.

Another such mode of reaction can be described as the "extraction mode" and it involves reaction between the alumina in the slag and the aluminum carbide in the furnace product so as to produce non-metallic slag compounds such as aluminum tetraoxycarbide, as opposed to producing liquid aluminum. Such "extraction mode" reactions occur at temperatures insufficient to cause reduction to produce additional aluminum and can occur without causing the evolution of carbon monoxide.

In general, temperatures of at least 2050° C. are necessary for the "reduction mode" operations at reaction zone pressures of one atmosphere. At any given pressure, the temperature required for "reduction mode" operation increases, as the level of aluminum carbide in the metal decreases. It is to be understood that "extraction mode" operations can take place below 2050° C., but the "extraction mode" can also take place along with the "reduction mode".

As taught in U.S. Pat. No. 4,216,010, decarbonization furnaces are operated to reduce aluminum carbide content of the furnace product from the primary furnace by adding alumina to the slag layer (containing CaO as a melting point depressant) to maintain a composition equivalent to a weight ratio of alumina to aluminum carbide in the range of 80–97% alumina, balance aluminum carbide, and preferably in the range of 85–90% $Al_2O_3$, balance $Al_4C_3$, using heat from open arcs in the complete absence of reactive carbon. The added alumina forms a cover over the melted primary furnace product, and additional primary furnace product is added to the decarb furnace without disturbing the alumina cover. After the carbide in the furnace product has been reduced to 2% by the extraction mode of operation at about 2000° C. in the decarb furnace, the metal layer is tapped to a holding or getter furnace where fluxing with Tri-Gas, according to the process of U.S. Pat. No. 3,975,187, for example, converts the metal to commercially pure aluminum.

However, the essence of this procedure is the formation of a solid alumina dome that is maintained over the alloy but is not in contact with it. This dome is necessarily sintered by the radiant heat from the arcs and provides thermal insulation of the melt and also recovers any aluminum vapor and aluminum oxide vapors that are evolved.

The presence of this structure requires a charging apparatus which can add liquid Al-$Al_4C_3$ alloy and recycled slag to the furnace without disturbing the dome. $Al_4C_3$ extraction takes place across the lower slag/metal interface, and the required alumina is added by controlled melting of the dome along its undersurface. This sintered alumina layer is stoked only when insufficient alumina is added by the melting process, and then the dome is immediately rebuilt. Therefore, solid alumina is never placed in contact with Al-$Al_4C_3$ alloy except when alumina additions cannot be accomplished by the standard procedures. Even though alumina additions, by melting from the dome, must fall through the alloy and $Al_4C_3$ extraction must take place while such drops are falling therethrough, the operating procedures of U.S. Pat. No. 4,216,010 do not optimize this phenomenon, and in fact, the formation of two-phase layers must generally be avoided in order to minimize slag entrainment in the metal product during tapping thereof.

In operation according to this procedure, the material throughout has been found to be limited by the slow rate of mass transfer which causes long holding times and increased energy consumption. To improve mass transfer, the concentration difference and/or the interfacial contact area must be increased. Because the ability to increase the concentration gradient is limited, it is necessary that the contact area be maximized.

SUMMARY OF THE INVENTION

It is accordingly an object of this invention to maximize the contact area that is available for mass transfer of aluminum carbide across interfaces between molten slag and molten primary furnace product in a decarbonization furnace which is operated in the extraction mode.

It is also an object to retain heat shielding and vaporization product capture capabilities until the removal of aluminum carbide has been completed.

It is further an object to minimize vaporization of aluminum metal and surface oxidation thereof after the removal of aluminum carbide has been completed.

In accordance with these objectives and the principles of this invention, a batch method for decarbonizing primary furnace product, having an aluminum carbide content of about 10–35%, to a useful level of about 2% $Al_4C_3$ is herein provided. The method is suitably conducted in the second component of a three-component apparatus, including a primary furnace in which reduction mode decarbonization produces a metal product containing 4–35% $Al_4C_3$, a decarbonization furnace in which extraction mode decarbonization produces purified aluminum containing about 2% $Al_4C_3$, and a finishing or getter furnace in which removal of the $Al_4C_3$ (such as with Tri-gas according to U.S. Pat. No. 3,975,187) produces finished or product aluminum.

As set forth more fully in the commonly owned application, Ser. No. 205,451, filed Nov. 19, 1980, all of which is hereby incorporated herein by reference, five operational process embodiments are preferably employed with five apparatus embodiments which are disclosed therein. These apparatus embodiments are operated according to the process embodiments as follows: (1) countercurrently feeding a portion of the alumina in the form of slag from the decarb furnace to the primary furnace; (2) feeding a portion of the alumina only into the reduction zone of the hearth in the primary furnace of the second apparatus embodiment; (3) feeding the entire charge to the twin permeably supported columns of the third apparatus embodiment; (4) feeding the entire charge to the twin fluidized columns of the fourth apparatus embodiment; and (5) feeding a portion of the alumina to the reduction zone for the hearth in the primary furnace of the fifth apparatus embodiment. The second process does not require recycling of alumina-rich slag as in the first process, which is preferably used for this invention.

The first process embodiment comprises three operations: crude aluminum production in a primary furnace that produces crude aluminum containing about 9.5% $Al_4C_3$ and 12% $Al_2O_3$ as the initial operation and then decarbonizing the crude aluminum in: (a) a decarbonization furnace to which much of the alumina is fed and which produces aluminum containing about 2% $Al_4C_3$ and slag as the second operation, and (b) a finishing or gas fluxing furnace that produces commercially pure aluminum and dross as the third operation. The term, "countercurrent", is appropriate for this process because the slag from the decarbonization furnace and dross from the finishing furnace are fed to the primary furnace, thereby moving countercurrently to the flow of aluminum.

The batch method of this invention is a process for operating a decarbonization furnace to reduce $Al_4C_3$ content of a primary furnace product from a maximum of about 35% (preferably about 20%) to about 2% by weight, but it is illustratively described as usefully conducted in a suitable decarbonization furnace for the first process embodiment of Ser. No. 205,451. It comprises extraction mode decarbonization of primary furnace product by:

A. providing a greatly increased interfacial area of alumina and a primary furnace product in the presence of a melting point depressant, such as calcium oxide, this increase in interacial area being accomplished by adding a charge of primary furnace product, i.e., an aluminum/aluminum carbide alloy, and an alumina slag containing calcium oxide to a decarbonization arc furnace having elevatable electrodes and then supplying power to the electrodes for heating the charge and forming a two-layered melt having a top melt surface;

B. adding a stoichiometric amount of granular alumina to the furnace and onto the top of the melt surface to form an alumina cover layer, whereby the cover layer insulates the top melt surface from radiant heat and captures aluminum vapors and aluminum oxide vapors emanating therefrom;

C. mechanically agitating the cover layer with sufficient regularity to cause the granular alumina to remain in intimate contact with the two-layered melt at the interface between the alumina cover layer and the top melt surface while continuing to supply electrical power to the electrodes for melting the alumina at the interface, whereby:

(1) the melted alumina is admixed with the two-layered melt by sinking into the melt and forming a two-phase liquid region within which extraction of aluminum carbide from the alloy takes place throughout the interfacial area of the region according to the reaction, $Al_4C_3+4Al_2O_3 \rightarrow 3Al_4O_4C$, so that the upper interface at the top melt surface and the alumina cover layer rises within the furnace as the reaction proceeds; and (2) the unreacted alumina descends to the slag layer so that the lower interface between the slag layer and the two-phase liquid region rises as the reaction proceeds;

D. elevating the electrodes to maintain arcs between the electrodes and the top melt surface while the upper interface also rises, whereby electrical conditions remain constant within the furnace; and E. when the alumina is completely melted and the two liquid phases have separated into purified aluminum floating on a terminal slag pool into which the slag layer and the $Al_4O_4C$ and unreacted $Al_2O_3$ in the two-phase layer have coalesced, employing the following steps:

(1) decreasing power input to the electrodes to minimize vaporization from the exposed aluminum surface and oxidation of aluminum along that surface, and (2) tapping the furnace and removing the purified aluminum therefrom.

Preferably, the terminal slag pool is additionally removed from the furnace, but a portion is left therein to form a residual slag pool which creates the lower interface at the bottom of the two-layered melt after step A. While this lower interface exists, the interface between the top melt surface and the alumina cover layer is an upper interface. The alumina melt is in the form of globules which are surrounded by the alloy melt within the two-phase region, as the upper layer of the two-layered melt, so that the globules furnish most of the interfacial area for the extraction of the aluminum carbide from the alloy within that two-phase region.

This liquid-phase extraction occurs according to the equation:

$$4Al_2O_3+Al_4C_3 \rightarrow 3Al_4O_4C.$$

The unreacted alumina and aluminum tetraoxycarbide in the globules descend to the lower interface and augment the residual slag pool to form the terminal slag pool.

DESCRIPTION OF THE PREFERRED EMBODIMENTS

The process of this invention is described hereinafter by means of the following four examples in which FIGS. 1-7 of the drawings are utilized. Example 1 illustrates the process of the invention as the second stage of a three-stage procedure for making product aluminum. Example 2 illustrates a prior art decarbonization procedure. Example 3 is a pilot plant replication of the second stage of Example 1, in isolation from the other stages, so that the metal product is added in granular form instead of as a liquid, the cover layer is added as a granular mixture of $Al_2O_3$+15% CaO, and the bottom layer is the residual of the final slag from the previous batch, containing $Al_2O_3$ and 15% CaO. Example 4 is a series of pilot plant slag extension experiments that demonstrate mass transfer time dependence upon concentration difference and/or interfacial contact area, thus serving as a guide for planning Examples 1 and 3.

EXAMPLE 1

Figure 1:
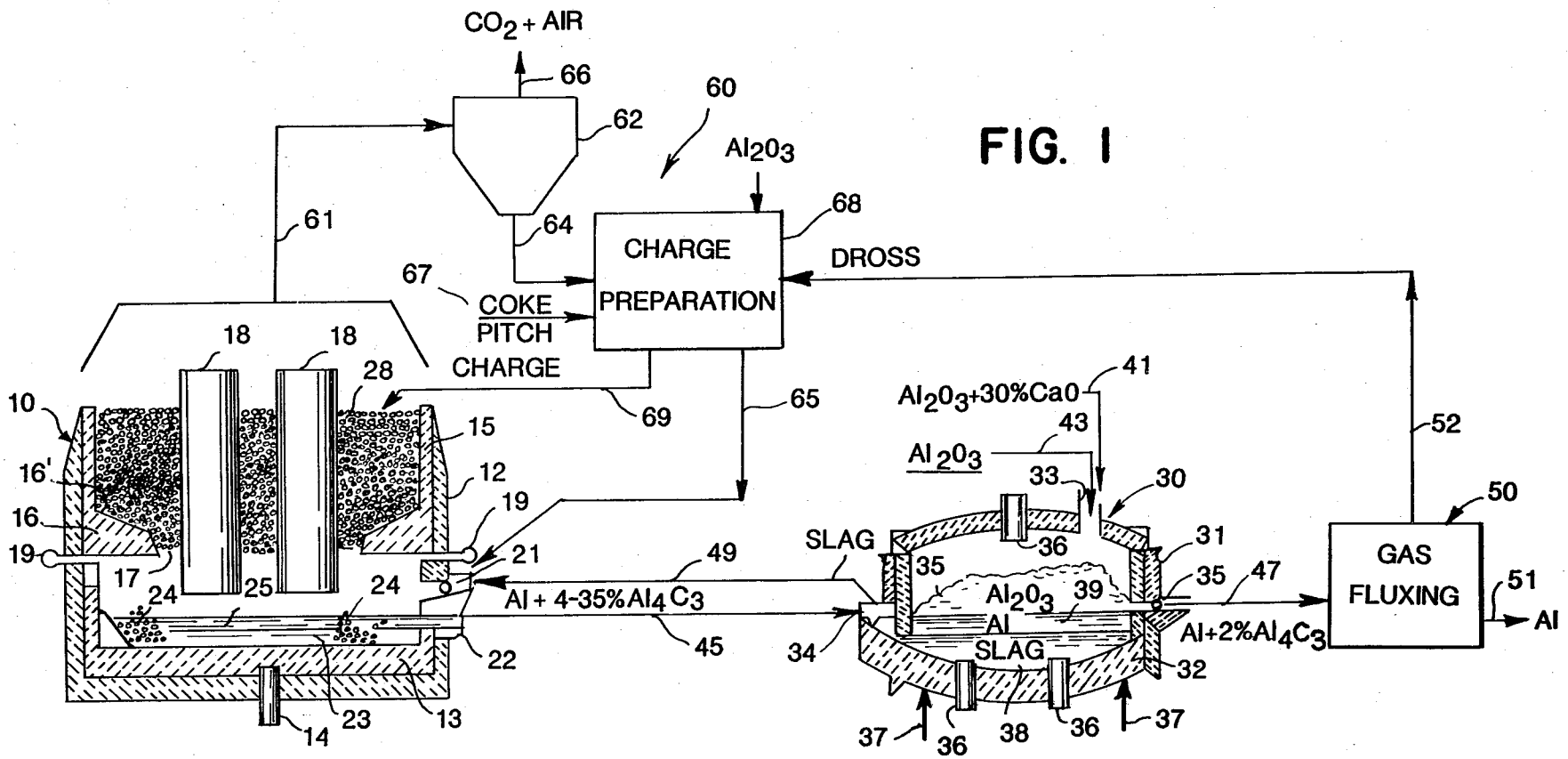
FIG. 1 is a schematically illustrated closed recycling system comprising three furnace components of which the moving bed shaft carbothermal reduction furnace and the operably connected decarbonization furnace are in sectional elevation.

The schematically illustrated closed recycling system shown in FIG. 1 is essentially the apparatus used for the first embodiment of Ser. No. 205,451. It preferably includes a primary furnace 10, a secondary furnace 30, and a gas fluxing furnace 50. Primary furnace 10 is a moving bed shaft carbothermal furnace which is lined with refractory brick 12 as insulation and has a hearth of carbon 13 which is connected to an electrical bus through graphite stubs 14. Inside the insulation is refractory lining 15 and inner roof 16 having an upper surface forming a shoulder 16' and shaped to allow a space 17 around electrodes 18 which are connected in parallel to a second side of the electrical circuit. Plenum and port means 19 are provided to maintain an inwardly directed flow of carbon monoxide to prevent condensation of aluminum across the inner wall, thus preventing the electrical short circuiting of roof 16 to hearth 13. A tapping port 22 and a charging port 21 are also provided.

Secondary furnace 30 is provided with insulation 31, inner refractory (non-carbonaceous) lining 32, charging port 33 for granular material, charging and tapping port 34 for transferring liquids to and from the primary furnace, and port 35 for tapping the product. Electrodes 36 are provided to conduct heating power through the liquid within furnace 30. Jacking means 37 are provided to raise furnace 30 so that liquids may be transferred from port 34 through line 49 to port 21 and the hearth of furnace 10. Primary furnace product is received in port 34 after passing through line 45 from port 22 of furnace 10. Furnace 30 is called the "DECARB Furnace".

A third furnace 50 is provided which is called the "Finishing Furnace". It is of conventional holding furnace design, being provided with a charging port, a tapping port, and a means to sparge fluxing gas under the top level of the furnace melt. The finished or product aluminum leaves furnace 50 through line 51, and dross leaves through line 52.

An auxiliary station 60, comprising a dust collector 62 and a charge preparation apparatus 68, is also provided. Duct collector 62 is used to separate fume and residual gases that are emitted through line 61 from furnace 10 and to return the fume through line 64 to charge preparation apparatus 68. In charge preparation apparatus 68, fume, dross, coke, and pitch entering through lines 64, 52, and 67, respectively, are mixed and prepared in the form of briquettes as charge composition B for furnace 10 which is fed through line 69, while allowing the cleaned residual gases to leave the system through line 66.

Charge column 28 is suitably made up in the form of briquettes having two compositions A and B. In the preparation of the briquettes for charge composition A (see U.S. Pat. No. 3,723,093, column 8, lines 50-65), aluminum hydroxide powder, prepared in accordance with the Bayer method, is converted to alumina powder by heating at 600°-1000° C. This alumina powder and a petroleum coke powder, fed through line 67 after grinding to pass a 100-mesh screen, are mixed in a weight ratio of 85:15 for preparing charge composition A. The briquettes are fed through line 64 to furnace 10. Briquettes of composition B may be baked to 800° C. to drive off binder fumes before being charged to furnace 10 through line 69.

The starting operation to bring the primary furnace up to its steady-state operating condition is carried out in the following manner. The furnace is initially heated by a flow of current from the electrodes to a bed of crushed coke as in the practice of starting a silicon furnace. When the hearth is adequately heated according to silicon furnace practice, sufficient alumina is added to the coke bed to form a liquid layer 23 over the hearth. The composition of liquid layer 23 is equivalent to a melt of alumina and aluminum carbide having alumina in the weight range of 80% to 97%. The preferred range is 85% to 90% $Al_2O_3$, the balance being $Al_4C_3$.

At this point, charge of composition A is added and the electrodes are pulled up to open arc condition in order to build up liquid layer 23 to a depth of approximately 12 inches. As charge is further added and is smelted to produce liquid for layer 23, additional alumina is added to maintain the weight ratio in liquid layer 23, in parts by weight ranging from 80 $Al_2O_3$/20 $Al_4C_3$, to 97 $Al_2O_3$/3 $Al_4C_3$. Only enough briquettes of composition A are added to provide the desired depth of layer 23 which is the "slag" layer. If the slag layer should become too lean in its content of $Al_4C_3$, a correction can be made by adding coke and continuing the heating under the open arc. When the molten slag layer of desired composition has been established, charge B is added to surround the electrodes above the roof 16, thus providing charge column 28 in which vapor products can react and release heat. An amount of charge from charge column 28, stoichiometrically equivalent to the metal to be tapped, is stoked to fall upon slag layer 23, forming reactant charge 24 upon and within the hearth. The electrodes are then lowered enough to make electrical contact with the liquid layer, and sufficient heat is generated by passage of electric current through liquid 23 to cause charge 24 to react with liquid slag layer 23. (In subsequent cycles, slag from furnace 30 is added through line 49 at this time to charge 24.)

As reduction proceeds, aluminum containing from 30% to 35% $Al_4C_3$ is formed and rests as a separate liquid metal layer 25 over slag layer 23. At the same time, some aluminum vapor and aluminum monoxide ($Al_2O$) gas are produced. These mix with CO formed by the aluminum producing reaction and pass upwardly through charge column 28 where exothermic back reactions occur, releasing heat and producing compounds which recycle down with the charge to produce aluminum carbide as temperatures become higher. The gases or vapors continue to rise through the charge column, becoming cooler and reacting further until the top of charge column 23 is reached and the residual gases pass through line 61 to apparatus 62 wherein fume is removed and the cleaned residual gases leave by line 66. The heat released within column 28 by these vapor back reactions is used to preheat charge and to provide heat to cause charge B to produce $Al_4O_4C$. At higher temperatures closer to the bottom of charge column 28 and to roof 16, the charge with composition B reacts with recycled vaporization products to produce $Al_4C_3$.

The electrodes are kept in contact with the charge or melt until substantially all reactive carbon in charge 24 is depleted and the composite (slag+charge) composition of liquid metal layer 25 and slag layer 23 has a molecular ratio N* equal to about 0.775, as moles $Al_2O_3$ divided by (moles $Al_2O_3$ plus moles $Al_4C_3$).

Liquid metal layer 25 may be sent to decarb furnace 30 as it is or it may be partially purified within furnace 10 before it is sent to furnace 30. To convert this metal product in layer 25, containing from 30 to 35% $Al_4C_3$, to a product containing about 10% $Al_4C_3$ or to any desired intermediate content of $Al_4C_3$, decarbonizing may be employed by pulling the electrodes just clear of layer 25, thereby causing open arc heating to begin. Such open arc heating requires a higher voltage between the electrodes than when the electrodes are in contact with the melt, but only enough voltage is applied to operate at such reduced current that the total power input is the same as or less than when the electrodes were in contact with the liquid layer.

This open arc heating is continued in furnace 10 until slag layer 23 has a composition N*=0.91 while employing the reduction decarbonization mode that is defined in U.S. Pat. No. 4,216,010. At this point, the metal product is an alloy which contains about 9.5% $Al_4C_3$ and 12% $Al_2O_3$ in solution. The liquid slag has a general temperature of about 2100° C., although the temperature where the arc strikes the liquid may be as high as 2400° C. Either temperature is high enough to allow metal layer 25 to rest as an immiscible liquid layer upon slag layer 23.

The metal product is then decanted through line 45 to decarb furnace 30 after a liquid slag recycle stream, that is enriched in CaO (on the order of 30%) at a temperature on the order of 1900° C., has been added to furnace 30 through line 41 and port 33 to form slag layer 38. More $Al_4C_3$ charge from the pre-reduction zone at the bottom of column 28 is stoked to fall onto slag layer 23 of furnace 10 and form more reactant charge 24, more recycled slag is added to slag layer 23, electrodes 18 are brought into contact with the hearth liquid, and the reduction process is cyclically repeated in primary furnace 10.

The heat intensity reaching the charge from the arc in furnace 10 must be limited, otherwise the vaporization will be so great that pre-heat and pre-reduction reactions in charge column 28 cannot absorb the back reaction heat. Under these conditions, the furnace is thermally unstable, and unreacted vapor products will blow out of the top of charge column 28, releasing excessive heat and wasting valuable reactants.

In furnace 30, which has been superheated to about 2100° C. in order to ensure that the product metal in line 45 is fluid enough to effect the transfer, the liquid metal product from furnace 10, containing about 9.5% $Al_4C_3$ and 12% $Al_2O_3$, for example, after purification in the primary furnace, is floated as metal layer 39 upon slag layer 38. This slag layer 38 contains about 30% CaO, which is all of the required calcium, and is a liquid which is immiscible with and has greater density than the $Al_4C_3$-Al metal layer when operating at about 1650° C. and higher. If any carbon is supplied to slag layer 38 before the liquid aluminum-aluminum carbide metal product or alloy from furnace 10 is charged through line 45 and port 34, it combines with the alumina in the pool formed as slag layer 38 and causes a small evolution of CO by the chemical reaction:

$$2Al_3O_3+3C \rightarrow Al_4O_4C+2CO.$$

After the aluminum-aluminum carbide alloy is charged through line 45, this reaction stops, because the small additions of carbon from the electrode are absorbed by the metallic aluminum which reacts to form aluminum carbide. Thus, CO evolution stops, but the previously formed CO has not been removed from the furnace atmosphere of closed furnace 30.

Argon is therefore added at a rate of 10 cubic feet per hour in order to purge the CO from the furnace atmosphere and establish an inert atmosphere. Applying the rule of thumb that one must displace five times the containing volume in order to purge a gaseous component from the container, the argon input displaces all of the evolved CO within about one hour after its evolution has stopped.

The alumina stoichiometrically required for making the aluminum product of decarb furnace 30 is then added through line 43 in order to form an insulating cover 35 and eventually go into the slag solution of layer 38 to maintain N*=0.96 after the $Al_4C_3$ is extracted from the metal according to the extraction mode of U.S. Pat. No. 4,216,010.

The granular alumina entering port 33 through line 43 is added to the top of the melt, i.e., to the top surface of layer 39, in a manner to form intimate contact with the liquid/solid Al-$Al_4C_3$ alloy in layer 39 as cover layer 35 is created.

As heat is applied, the alumina in layer 35 begins to melt and sink through the less dense Al-$Al_4C_3$ alloy. This forms a two-phase region consisting of molten alumina and Al-$Al_4C_3$ alloy where the $Al_4C_3$ in the alloy is transferred to the slag across the large interfacial area of this region. The granular alumina self-feeds to the pool through an area with dimensions roughly equal to the electrode diameter and spacing. This feeding phenomenon requires that the $Al_2O_3$ be regularly stoked to ensure contact with the molten alloy or alloy/slag phases. As the alumina melts, the liquid level of the pool increases, thus requiring the top electrodes to be raised at an equal rate. This ensures that the top electrodes never come in contact with the melt and that the electrical conditions remain constant. The molten alumina continues its descent through the two-phase region and reports to the lower slag pool.

The aluminum carbide extraction takes place in the two-phase region. The mechanism for decarbonization is slag extraction, not further reduction, via the chemical reaction:

$$Al_4C_3+4Al_2O_3=3Al_4O_4C.$$

The slag layer increases in volume because the CaO, the $Al_4O_4C$, and the unreacted alumina descend thereto and combine therewith. The term "stoichiometric" applies to the total process, i.e., the stoichiometric quantity of alumina required to produce the product aluminum, not to decarbonize the aluminum-aluminum carbide alloy. Generally, the amount of alumina that is required to absorb the $Al_4C_3$ is equal to the amount required to produce the aluminum product.

When the power is brought up to operating level, the top arc supplies sufficient energy and temperature to melt the alumina cover. Also, the superheat of the aluminum-aluminum carbide alloy contributes energy to the alumina charge, thus lowering the metal phase temperature. As liquid alumina contacts the primary furnace product, it absorbs impurities, and its melting temperature decreases, thus providing more superheat which is absorbed by the solid alumina and/or dissipated by the furnace sidewalls. When the two-phase region is completely established, the impurities have been extracted from the metal phase, and a vehicle has also been established wherein the CaO may diffuse upward from the CaO-rich portion of slag pool 38 into the alumina of the two-phase region. This diffusion and composition change also lowers the melting point of the slag phase and is enhanced by the turbulence produced by the top arcs. This superheat is also dissipated by the furnace sidewalls, thus lowering the liquid temperature further.

The extent to which the slag temperature is decreased from the melting temperature of alumina depends on the rate of diffusion of CaO into the alumina of the two-phase region. Calculation of this rate is not possible due to the lack of knowledge of the diffusivity of CaO into alumina or the velocity pattern established by the arcs, but the initial composition difference is fairly high (30 wt.% CaO in slag as compared to 0 wt.% CaO in the alumina) and the agitation of the melt allows sufficient mixing and lowers the melt temperature to the acceptable range of 1600°-1800° C.

Once the alumina is completely melted, the liquid phases separate with the purified aluminum floating on the slag pool. The product aluminum is then transferred to a gas fluxing furnace 50, by tilting furnace 30 with jacks 37, and the produced slag is recycled through line 49 to the primary furnace for reduction, by being added to charge 24 which has dropped from column 28.

Melt treatment times are solely dependent on the power input, i.e., the KWHs required to melt the charge and offset the furnace heat losses. Once sufficient power has been supplied and the phase inversion is complete, the power input is dropped to idling capacity to avoid excessive vaporization of the exposed purified aluminum during tapping. The power is subsequently increased to the desired level after the next charge.

This method of operating furnaces 10 and 30 in combination embodies an important discovery that, by providing for the addition of the process alumina requirement to the decarb furnace or to the primary furnace hearth instead of to charge B, the percent liquid in the upper part of column 28 can be reduced to 35%, compared to about 79% if all the alumina requirements are added with charge B. By keeping charge B as rich in carbon as possible and by encasing the alumina of the dross in pitch coke, the briquettes are less likely to sinter together and cause charge column 28 to slump, so that the charge column remains in vapor-permeable condition and continues to allow the $Al_2O$ vapors to permeate therethrough and back react to equilibrium, thus minimizing energy losses caused by aluminum vaporization.

Because slag recycle stream in line 41 contains all the CaO required in decarbonization furnace 30, an essentially closed CaO loop is formed between the primary and decarbonization furnaces. This closed loop drastically reduces the CaO consumption of the process and requires that pure $Al_2O_3$ be added as the cover and decarbonization charge in layer 35. However, if a smaller content of CaO is in layer 35, a compensating amount of CaO must be added in cover layer 35. At 15% CaO in layer 38, the CaO content in layer 35 is also 15%.

Purification to product grade aluminum is accomplished by sparging Tri-Gas or some other conventionally used aluminum fluxing gas into the melt in finishing furnace 50, until all of the alumina and aluminum carbide present in the metal product from furnace 30 has come to the surface of the aluminum as a dross. This operation occurs at about 900° C. The dross is skimmed and incorporated into primary furnace charge briquettes in apparatus 68 after passing through line 52 without significant delay, so that the aluminum carbide does not have an opportunity to hydrolyze. Finished aluminum product of commercial purity is then tapped from finishing furnace 50 through line 51 to complete the process.

EXAMPLE 2

Figure 2:
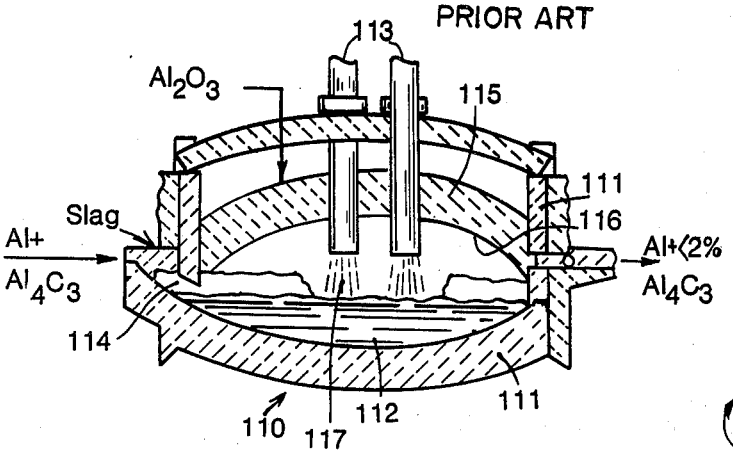
FIG. 2 PRIOR ART
FIG. 2 represents a decarbonization furnace which is operated according to the procedures described in U.S. Pat. No. 4,216,010.

A decarbonization furnace 110, as seen in FIG. 2, has a bottom and insulated sides 111 and a roof through which two movable top entry electrodes 123 are installed. A liquid slag recycle stream, at a temperature of about 1900° C., is charged to furnace 110 and forms a slag layer 112, having $N^*=0.91$ and about 30% CaO.

A liquid metal product from a primary furnace, at a temperature of about 2100° C., is charged next to furnace 110. This metal product is aluminum containing about 9.5% $Al_4C_3$ and 12% $Al_2O_3$, and forms a metal layer 114, overlying layer 112 and having $N^*=0.64$. Both layers 112 and 114 are liquids at an operating temperature of 1650° C., the slag layer 112 having a greater density than the $Al_4C_3$-Al metal layer 114. Most of the alumina that is stoichiometrically required to produce an aluminum product is then added to furnace 110 to form an insulating domelike cover 115 and eventually go into slag solution 112 to maintain $N^*=0.91$ after the $Al_4C_3$ has been extracted from the metal.

No particular measures are taken to admix the materials of layer 115 with the metal of layer 114. Decarbonized metal is tapped from layer 114, slag is tapped from layer 112, new primary furnace product is added to form a new layer 114, and molten slag from the primary furnace is added, all without disturbing alumina layer 115 which is present as a solid dome above arcs 117. The molten slag that is charged reports directly to layer 112. Mass transfer between layers 112 and 114 is at their liquid-liquid interface. This interface area is somewhat greater than the cross-section of the liquid pool because of agitation caused by open arcs 117 and other sources of force within the molten pool.

More specifically, the portion of the insulating cover of $CaO/Al_2O_3$, as seen in FIG. 2, that surrounds arcs 117 melts from exposure to the radiant heat to form a progressively thinner but self-supporting insulating dome 115. Melted drops of calcium oxide and alumina fall from inner surface 116 of insulating cover 115 into metal layer 114 and pass therethrough to join slag layer 12 or run along surface 116 to the edges of dome 115 where they sink through liquid layer 114. When insufficient alumina is released by this melting, sintered slag layer 115 is stoked to add granular alumina to slag layer 112. The amount of alumina so added, however, is small in relation to the total amount of alumina in layer 115 which is needed for insulating purposes. Immediately thereafter, more slag is added to preserve the heat shield and vaporization product recapture properties of the cover layer which quickly becomes re-established as sintered dome-shaped layer 115.

However, the metal-slag contact area that is available, at the interface between layers 112, 114 and at the interfaces around the molten drops from alumina dome 115, substantially limits mass transfer rates and material throughput.

When metal layer 114 is suitably fluid and has a $Al_4C_3$ level of about 2%, metal decanted from metal layer 114 and sent to a finishing furnace for purification, such as by sparging Tri-Gas or some other conventionally used fluxing gas into the melt until all of the alumina and aluminum carbide present in the metal product has come to the surface of the aluminum as a dross. This operation occurs at about 900° C.

EXAMPLE 3

Figure 3:
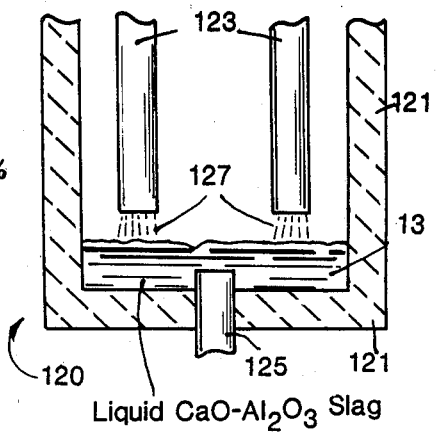
FIG. 3 is a crucible-type decarbonization furnace having two top entry electrodes and one bottom stub electrode, before primary furnace product and stoichiometric amounts of slag have been charged thereto.

An experimental furnace, as a 20-inch I.D. crucible 120 having bottom and sides 121, a bottom stub electrode 125, and a pair of top-entry electrodes 123, as seen in FIG. 3, is used to test the decarbonization method of this invention, as a simulation of the operation of decarb furnace 30 in Example 1. A residual pool 131 of slag covers stub 125. A sample of residual slag pool 131 is taken, and the pool depth of layer 131 is measured as $3\frac{1}{2}$ inches. The composition of pool 131 is 85% $Al_2O_3$ and 15% CaO by weight.

Then 35 pounds of $Al\text{-}Al_4C_3$, alloy, containing 63% Al, 7.4% $Al_4C_3$, and the balance oxides, is charged to crucible 120, covering residual pool 131. Power is turned on to electrodes 123, creating arcs 127 and establishing a current path which consists of arcing from electrodes 123 to the alloy and then conduction from the alloy through slag 131 to bottom stub 125.

Figure 4:
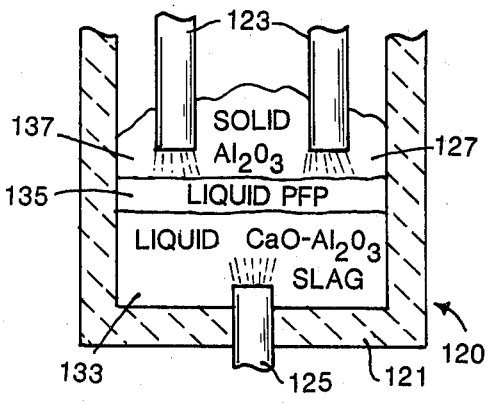
FIG. 4 shows the crucible-type furnace of FIG. 3 after addition of both primary furnace product and alumina cover layer and after partial operation of the furnace.

After charging the 35 pounds of alloy and the 25 pounds of slag and operating for about one-half hour, crucible 20 appears as in FIG. 4, with a considerably deeper slag layer 133, a liquid alloy layer 135, and a layer of solid slag 137 of considerable depth which completely covers electrodes 123 and arcs 127.

The alumina in layer 137 begins to melt in the vicinity of arcs 127 and sinks through the less dense $Al\text{-}Al_4C_3$ alloy 35 in the form of globules as heat is applied. This activity forms a two-phase region 146, consisting of molten alumina and $Al\text{-}Al_4C_3$ alloy, wherein the $Al_4C_3$ in the alloy is transferred to the slag across the larger interfacial area of this region, according to the reaction:

$$Al_4C_3 + 4Al_2O_3 \rightarrow 3Al_4O_4C.$$

The granular alumina in cover layer 137 self-feeds to the pool of alloy throughout a rectangular area with dimensions roughly equal to electrode diameter plus the spacing therebetween. This feeding phenomenon is accomplished by regularly stoking alumina cover layer 137 to assure contact with the molten alloy or alloy/-slag phases and to prevent the formation of a sintered surface in the vicinity of arcs 127.

Figure 5:
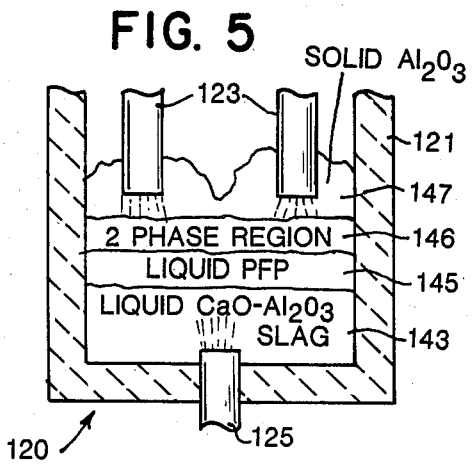
FIG. 5 shows the furnace of FIGS. 3 and 4 after additional operation thereof.

After one hour, as shown in FIG. 5, the total pool depth, representing the combined depths of liquid slag layer 143, liquid alloy layer 145, and liquid two-phase region 146, equals between $5\frac{1}{4}$ inches and $5\frac{1}{2}$ inches. Layer 146 is about 1 inch of mixed slag and metal in thickness. After 1.5 hours, the total pool depth is about 6 inches, including two inches of mixed slag and metal.

Figure 6:
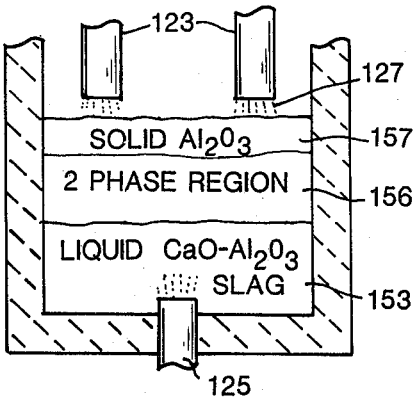
FIG. 6 shows the same furnace after further operation thereof.

After 1.75 hours, an additional 25 pounds of comminuted slag, containing 85% $Al_2O_3$ and 15% CaO, and made by mixing the granular components, is charged into crucible 120. Heating is continued until at 2.0 hours the total pool depth is $6\frac{1}{2}$ to 7 inches and the composition of the layers is as seen in FIG. 6. Liquid slag layer 153 is of diminished thickness as compared to layer 143, and two-phase region 156 is greatly increased in thickness as compared to region 146, with solid slag layer 157 being nearly consumed and alloy layer 145 having disappeared.

Figure 7:
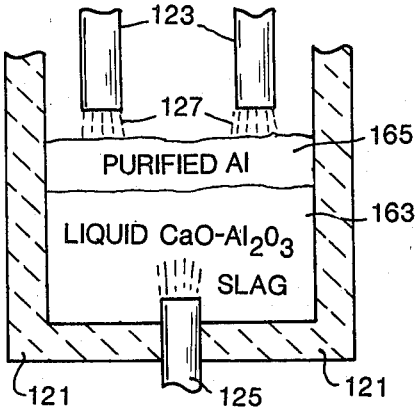
FIG. 7 shows the furnace of FIGS. 3-6 after the decarbonization cycle has been completed and the power has been returned to idling level, before tapping the layer of purified aluminum and the liquid slag layer.

After 2.75 hours, the pool depth is 7 inches, with slay layer 163 being $5\frac{3}{4}$ inches in depth and purified aluminum layer 165 being 1 to $1\frac{1}{4}$inches in thickness, as seen in FIG. 7. The phase inversion being complete, furnace power to electrodes 123 is dropped to idling level and continued at that level for another 1.25 hours.

Crucible 120 is then tapped about 4 hours after charging of the alloy, and 23.2 pounds of decarbonized metal is poured to form a single ingot, followed by 43.2 pounds of slag containing an additional 2 pounds of aluminum which are recovered after roll crushing the slag, as is known in the art, so that 97.3% of the aluminum is recovered. The decarbonized metal contains 85.2% Al, 1.2% $Al_4C_3$, and 13.6% oxides.

Such roll crushing is generally needed because during any metal and slag tap, small amounts of metal are entrained in the slag and after solidification are in the form of porous spheres ranging in diameter from 2–3 inches to conceivably microscopic size. When the solidified slag tap is placed in a roll crusher, the slag, but not the metal, is reduced to a fine powder. The crushed material is then screened to +16 mesh and −16 mesh fractions, and +16 mesh portion being the two pounds of entrained aluminum in the run which are combined with the 23.2-pound ingot for further processing.

The remaining 2.7% of the aluminum in this run consists of three items:

(1) a protion of the entrained metal spheres that is attrited in the roll crusher to a −16 mesh size and incorporated in the slag after screening;

(2 ) a small portion of metal that is dissolved in the slag; and (3) other material handling losses during the tapping and crushing process.

The metal losses in the first item make up the bulk of the 2.7%. These losses, along with the dissolved metal in the second item, are eventually recycled in a total process, so that there is no energy or material penalty for a commercial operation. The losses in the third item are very small and unrecoverable.

During the run, samples of gas that evolve from crucible 120 are taken and analyzed for CO and $CO_2$. The test results are shown in the following table.

| Time Hours | % CO | % $CO_2$ | Comments |
|---|---|---|---|
| 0 | 26.64 | 4.68 | Initial sample and metal charged |
| 0.25 | 9.1 | 0.84 | Sample taken 15 minutes after metal charge |
| 0.75 | 4.55 | 0 | 45 min. after metal charge |
| 1.2 | 0 | 0 | 72 min. after metal charge |

These results indicate that decarbonization was accomplished by slag extraction as opposed to further production, as evidenced by the rapid decay of CO.

The dip samples show that the phase inversion does occur and that the slag passes through the metal layer, forming an intimately mixed layer of metal and slag. It is apparent that mass transfer occurs across the slag/-metal interfaces in the mixed region (two-phase regions) 146, 156) which has an unknown but high amount of interfacial area for active carbide transfer thereacross.

It is further apparent that the time to complete the phase inversion is simply the time required to supply power to melt the charge and is in no way representative of a mass-transfer operation. These results also indicate that the increased metal-slag contact area, in two-phase regions 146, 156, all but alleviates any mass transfer limitation on the process and that metal treatment times are governed by the rate of charge melting. This accomplishment substantially increases material throughput and lowers the energy required to decarbonize the metal by lowering the furnace heat losses per pound of alloy treated. The slag cover also has substantial insulating value, insuring complete melting of the charge and alleviating metal crusting and other associated operational problems. In addition, slag cover 137, 147 also isolates metal layers 135, 145 from the furnace atmosphere for the majority of the treatment time, thus decreasing the possibility of metal oxidation.

The aluminum recovery is on the order of 97.3%, the other 2.7% of the aluminum being transferred to the slag with the aluminum carbide. The aluminum remains in a metallic state and is not oxidized.

EXAMPLE 4

A preliminary series of slag-extraction experiments is performed in an 11-inch I.D. crucible with power supplied by resistance heating of the slag through horizontal electrodes passed through the crucible walls. The basic operating procedure is summarized in the following statements:

(a) Metal charges are commenced when the slag layer is level with the bottom of the taphole.

(b) Each tap cycle consists of five-to-ten one-kg charges of Al-$Al_4C_3$ alloy, made at approximately one-half hour intervals.

(c) After each alloy charge, one-half kg of 85% $Al_2O_3$-15% CaO slag, consisting of bubble $Al_2O_3$ and prefused 50% $Al_2O_3$-50% CaO slag, is charged for insulation.

(d) The melt is held at temperature for 30–100 minutes after the last alloy charge.

(e) The melt is tapped and another cycle is initiated.

Data taken from four experiments from this series show a time dependence for the decarbonization process. The following table consists of the experiment and cycle number, the charging rate, melt holding time after the last alloy charge, and an index of the mass transfer operation; namely the percent change in $Al_4C_3$ content of the metal. The initial cycles of the experiments are chosen because the carbon level in the slag is at its lowest point, thus minimizing the equilibrium constraint on mass transfer.

MASS TRANSFER TIME DEPENDENCE

| Expt. No. | Cycle No. | Charge Rate (g/min) | Hold Time After After Last Metal Charge, min | % $Al_4C_3$ Removed |
|---|---|---|---|---|
| 4-61 | I | 34.1 | 84 | 73.6 |
| 4-61 | II | 24.6 | 98 | 87.5 |
| 4-25 | I | 21.3 | 85 | 87.6 |
| 4-32 | I | 33.3 | 31 | 67.6 |
| 4-45 | I | 33.1 | 49 | 80.2 |

In general, the data show that the cycles having the lowest charging rates and highest holding times have the greatest amount of mass transfer. The most striking example is shown in Cycles I and II of Experiment 4-61, where Cycle II lowers the $Al_4C_3$ content by an additional 13.9% over Cycle I, while employing a 10 g/min slower charging rate. The lowest mass transfer occurs in Experiment 4-32 where the melt is held for only 31 minutes after the last alloy charge. This series of runs are plagued, however, by metal crust formation, oxidation, and incomplete melting of the alloy.

In summary, the slow rate of mass transfer limits the material throughput, causing long holding times and increased energy consumption. To improve mass transfer, the concentration difference and/or the interfacial contact area must be increased. Examples 1 and 3 describe a method for maximizing the contact area by the phase-inversion technique.

What is claimed is:

1. A batch method for decarbonizing primary furnace product from an aluminum carbide content of up to about 35% to a useful content of about 2% $Al_4C_3$ by maximizing mass transfer of said aluminum carbide between molten slag and molten primary furnace product in a decarbonization arc furnace which has elevatable electrodes and is operated in the extraction mode, comprising the operation of said decarbonization furnace according to the following steps:

A. providing a greatly increased interfacial area of alumina and said primary furnace product in the presence of a melting point depressant, said providing being accomplished by adding a charge of primary furnace product, as an aluminum/aluminum carbide alloy, and an alumina slag, containing said depressant, to said decarbonization arc furnace for forming a two-layered melt, as an underlying molten slag layer and an overlying layer of alloy melt having a top melt surface;

B. adding a stoichiometric amount of granular alumina to said furnace and onto said top melt surface to form an alumina cover layer, whereby said cover layer insulates said top melt surface from radiant heat and captures aluminum vapors and aluminum oxide vapors emanating therefrom;

C. mechanically agitating said cover layer with sufficient regularity to cause said granular alumina to remain in intimate contact with said top melt surface while continuously supplying electrical power to the electrodes for melting said alumina, whereby:

(1) the melted alumina sinks into said alloy melt and forms a two-phase liquid region within which extraction of aluminum carbide from said alloy takes place across a plurality of interfaces throughout said region, according to the extraction reaction: $Al_4C_3+4Al_2O_3 \rightarrow 3Al_4O_4C$, so that said top melt surface becomes an upper interface which rises within said furnace as said reaction proceeds; and (2) the unreacted melted alumina and aluminum tetraoxycarbide from said reaction descend to said underlying molten slag layer so that the lower interface between said slag layer and said two-phase liquid region also rises as said reaction proceeds;

D. elevating said electrodes to maintain arcs between said electrodes and said upper interface while said upper interface rises, whereby electrical conditions remain constant within said furnace; and E. when said alumina is completely melted and said liquid region and said slag layer have separated into purified aluminum floating on a terminal slag pool into which said slag layer and said $Al_4O_4C$ and unreacted $Al_2O_3$ in said two-phase region have coalesced, employing the following steps:

(1) decreasing power input to said electrodes in order to minimize vaporization from said purified aluminum and oxidation of aluminum along the upper surface thereof, and (2) tapping said furnace and removing said purified aluminum therefrom.

2. The batch method of claim 1, wherein said melting point depressant is calcium oxide.

3. The batch method of claim 2, wherein said molten slag layer in Step A contains about 30% CaO as said melting point depressant.

4. The batch method of claim 3, wherein said slag layer is a liquid which is immiscible with and has greater density than said alloy melt when said furnace is operating at at least 1650° C.

5. The batch method of claim 4, wherein any carbon supplied to said slag layer, before addition of said alloy in Step A, combines with alumina in said slag layer and causes a small evolution of carbon monoxide by the chemical reaction:

$$2Al_2O_3+3C \rightarrow Al_4O_4C+2CO.$$

6. The batch method of claim 5, wherein argon is added to said furnace in sufficient volume to purge said evolved CO from said furnace within approximately one hour.

7. The batch method of claim 1, wherein said terminal slag pool is additionally removed from said furnace until a portion remains that forms a residual slag pool which creates said lower interface in Step C after adding only said primary furnace product in Step A.

8. The batch method of claim 1, wherein said melted alumina in Step C is in the form of globules which are surrounded by said alloy melt within said two-phase region, so that said globules create said plurality of interfaces and furnish most of said greatly increased interfacial area of Step A for said extraction of said aluminum carbide from said alloy.

9. The batch method of claim 8, wherein the heat shielding and vaporization product capture capabilities of said cover layer are retained until the removal of said aluminum carbide from said alloy melt has been substantially completed.

10. The batch method of claim 1, wherein said primary furnace product contains up to about 20% $Al_4C_3$.

11. The batch method of claim 10, wherein said primary furnace product contains about 9.5% $Al_4C_3$ and about 12% $Al_2O_3$.

12. The batch method of claim 3, wherein a liquid slag recycle stream, at a temperature of about 1900° C., is charged to said furnace in Step A and forms said underlying molten slag layer containing about 30% CaO and having a molar ratio of moles $Al_2O_3$ to (moles $Al_2O_3$ plus moles $Al_4C_3$) of about 0.91.

13. The batch method of claim 12, wherein said primary metal furnace product is liquid at a temperature of about 2100° C., is primarily aluminum containing about 9.5% $Al_4C_3$ and 12% $Al_2O_3$, and forms said overlying alloy melt having a molar ratio of moles $Al_2O_3$ to (moles $Al_2O_3$ plus moles $Al_4C_3$) of about 0.64 after addition thereof according to Step A.

14. The batch method of claim 1, wherein said granular alumina is added according to Step B for maintaining the molar ratio of moles $Al_2O_3$ to (moles $Al_2O_3$ plus $Al_4C_3$) at about 0.91 in said terminal slag pool.

* * * * *